US006032694A

United States Patent [19]

Wellen et al.

[11] Patent Number: 6,032,694

[45] Date of Patent: Mar. 7, 2000

[54] BIMINI PLUG

[75] Inventors: Gerald E. Wellen, North Branch; Robert J. Menne, Jr., Forest Lake, both of Minn.

[73] Assignee: Premier Marine, Inc., Wyoming, Minn.

[21] Appl. No.: 08/982,855

[22] Filed: Dec. 2, 1997

[51] Int. Cl.[7] ..... F16L 55/11

[52] U.S. Cl. ..... 138/89; 138/96 R; 215/320; 215/355; 220/DIG. 19; 220/801

[58] Field of Search ..... 138/89, 89.1–89.4, 138/90, 96 R; 215/355, 357, 320; 220/DIG. 19, DIG. 33, 796, 800–802

[56] References Cited

U.S. PATENT DOCUMENTS

| | | | |
|---|---|---|---|
| 3,349,532 | 10/1967 | Dudoff | 52/301 |
| 3,578,027 | 5/1971 | Zopfi | 138/89 |
| 3,977,654 | 8/1976 | Etherington et al. | 138/96 R |
| 5,307,841 | 5/1994 | Condon | 138/89 X |
| 5,327,942 | 7/1994 | Black | 138/89 |
| 5,423,351 | 6/1995 | Keating | 138/89 X |
| 5,499,737 | 3/1996 | Kraus | 138/89 X |
| 5,547,042 | 8/1996 | Platt | 138/89 X |
| 5,575,317 | 11/1996 | Behnke, III et al. | 138/89 X |
| 5,701,935 | 12/1997 | Vasudeva | 138/89 X |

FOREIGN PATENT DOCUMENTS

| | | |
|---|---|---|
| 536228 | 11/1955 | Italy . |
| 1551855 | 9/1979 | United Kingdom . |

*Primary Examiner*—Patrick Brinson
*Attorney, Agent, or Firm*—Hugh D. Jaeger

[57] ABSTRACT

Plug for capping or sealing the open ends of tubular members, such as tubular support members utilized on a Bimini boat top or other boat structure. The plug has a cap from which extend upper and lower rearwardly projecting tapered planar support panels each of which includes an outwardly protruding array of ramped teeth formed integrally therewith. The height of the teeth in each array increases incrementally from a minimum height near the end of the plug remote from the cap to a maximum height adjacent to the cap. The ramping of the teeth allows for accommodational frictional engagement of the teeth with various inside dimensions of tubular support members to secure the plug tightly therewithin. A hole extends transversely through the body of the plug for receipt of a pin for pivotally securing the end of a tubular support member containing the plug to a support bracket or other members.

20 Claims, 6 Drawing Sheets

BIMINI PLUG

CROSS REFERENCES TO CO-PENDING APPLICATIONS

None.

BACKGROUND OF THE INVENTION

1. Field of the Invention

The present invention relates to a plug, and more particularly, pertains to a plug for capping or sealing an open end of a tubular member. The plug of the invention is especially useful for capping or sealing the open ends of tubular members used for supporting purposes, and has particular application in conjunction with tubular support members utilized on boats, such as in a Bimini top or other boat structure involving tubular support members having open ends requiring capping or sealing. However, the plug is useful with tubular support members found in any other environment, or with tubular members in general.

2. Description of the Prior Art

Prior art sealing plugs for closing the open ends of tubular support members have required a number of time-consuming installation steps, such as drilling of body holes in the sides of a tubular support member for subsequent insertion of screw, bolt or pin members through the body holes into the plug to retain the plug in the open end of the tubular support member. Other plugs have been secured into the open end of a tubular support member with adhesive, only to have the adhesive deteriorate with the passage of time and with thermal changes, thereby causing the plug to disengage itself from or become loose in the tubular support member. Some plugs have formed a close tolerance fit with the interior of a tubular support member, but with age or heating and cooling have shrunk and become loose in or disengaged themselves from the tubular support member. Clearly what is needed is a plug which can be installed in the open end of a tubular support member with a minimum of tools, or even with no tools, which does not require excessive installation labor, and which is not affected by heat, cold or adhesive or material deterioration. The present invention provides such a plug.

SUMMARY OF THE INVENTION

The general purpose of the present invention is to provide a plug to be used to cap or seal the open end of a tubular member such as a tubular support member used in a boat top structure or other boat structure. Sealing of the open ends of tubular support members is accomplished for a variety of reasons. Sealing of a tubular support member on a boat prevents one from inserting a finger into the open end of the tubular support member where injury could occur during boating activities. Exposed uncapped tubular support members present sharp edges or corners which could cause bodily harm if mistakenly contacted. Sealing also prevents insects from entering or building nests in the tubular support member. The plug also aids in the connection of the tubular support member to a rail of a pleasure craft. In the plug of the invention, a series of opposing arrays of ramped teeth are included on opposing sides of the plug for the purpose of frictional engagement with the interior of a tubular support member. The teeth are ramped or sloped to provide increasing frictional contact with various wall thickness tubular support members. As the plug is inserted further into the tubular support member, the teeth are brought into increasing flex contact with the inner surfaces of the tubular support member.

According to one embodiment of the present invention, there is provided a plug having a plurality of connected planar members extending perpendicularly from a planar surface of a cap member. These connected planar members include horizontally oriented upper and lower tapered planar support panels, vertically oriented outer support panels and a vertically oriented center support panel extending between the horizontally oriented upper and lower tapered planar support panels, opposing arrays of ramped teeth located on the upper and lower surfaces of the horizontally oriented upper and lower tapered planar support panels and formed integrally therewith, and a series of horizontally aligned holes located in the vertically oriented outer support panels and the vertically oriented center support panel for accommodation of a mounting pin. Together the horizontally oriented upper and lower tapered planar support panels, the vertically oriented outer support panels and the vertically oriented center support panel, and the opposing integrally formed arrays of ramped teeth are inserted into the interior of a tubular support member and held therein by frictional engagement to fill and plug off the open end of the tubular support member.

One significant aspect and feature of the present invention is a one-piece plug which frictionally engages the open end of a tubular support member such as used in marine canopy support equipment.

Another significant aspect and feature of the present invention is the provision of opposing arrays of ramped teeth on the plug which increasingly engage the interior of a tubular support member in frictional engagement.

Another significant aspect and feature of the present invention is a plug which remains in place even with temperature excursions.

Another significant aspect and feature of the present invention is a plug which can be installed with a minimum of tools, or preferably with no tools.

Another significant aspect and feature of the present invention is a plug whose installation is not hampered by the need for drilling of holes or installation of holding pins or screws.

Another significant aspect and feature of the present invention is a plug including holes for accommodation of a pin used for mounting of canopy support structure.

Another significant aspect and feature of the present invention is a plug which is self-locating and self-aligning.

Another significant aspect and feature of the present invention is a plug which seals the open end of a tubular support member for prevention of bodily injury.

Another significant aspect and feature of the present invention is a plug which seals the open end of a tubular support member to prevent the entry of insects, debris, water and the like.

Having thus described significant aspects and features of an embodiment of the present invention, it is the principal object of the present invention to provide a plug for capping or sealing the open end of a tubular support member.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

Figure 1:
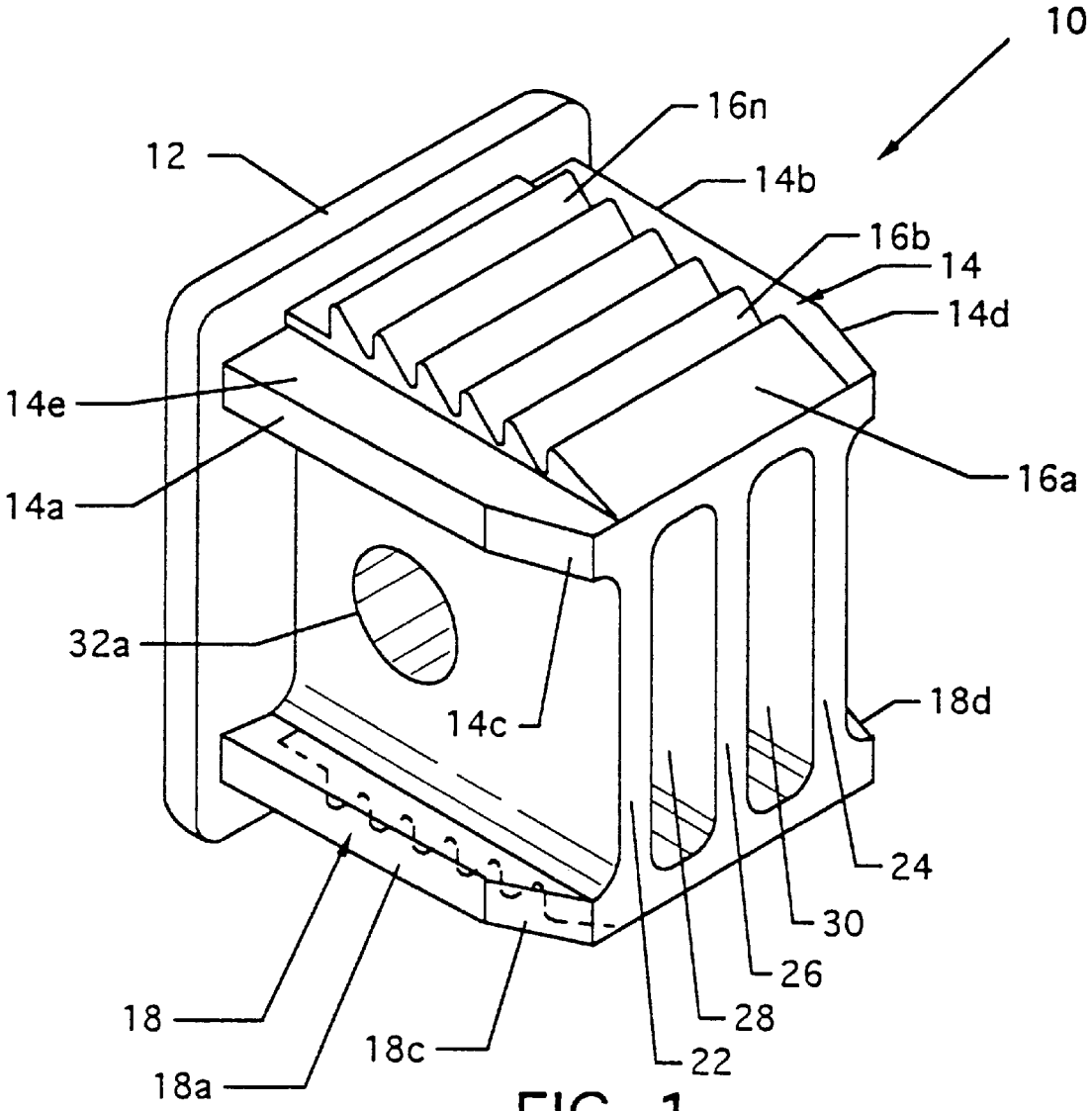
FIG. 1 illustrates an isometric view of a plug.
Figure 2:
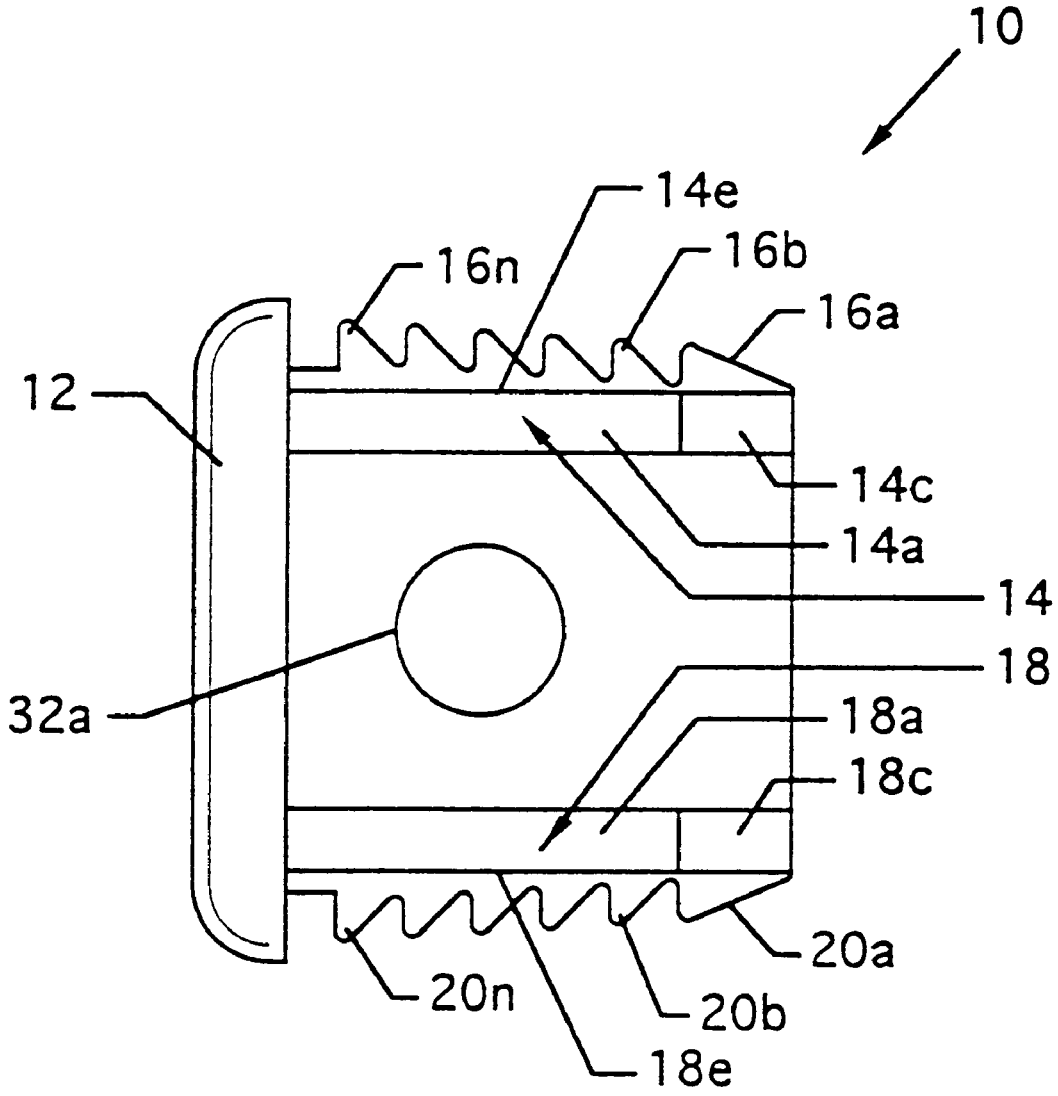
FIG. 2 illustrates a side view of the plug.
Figure 3:
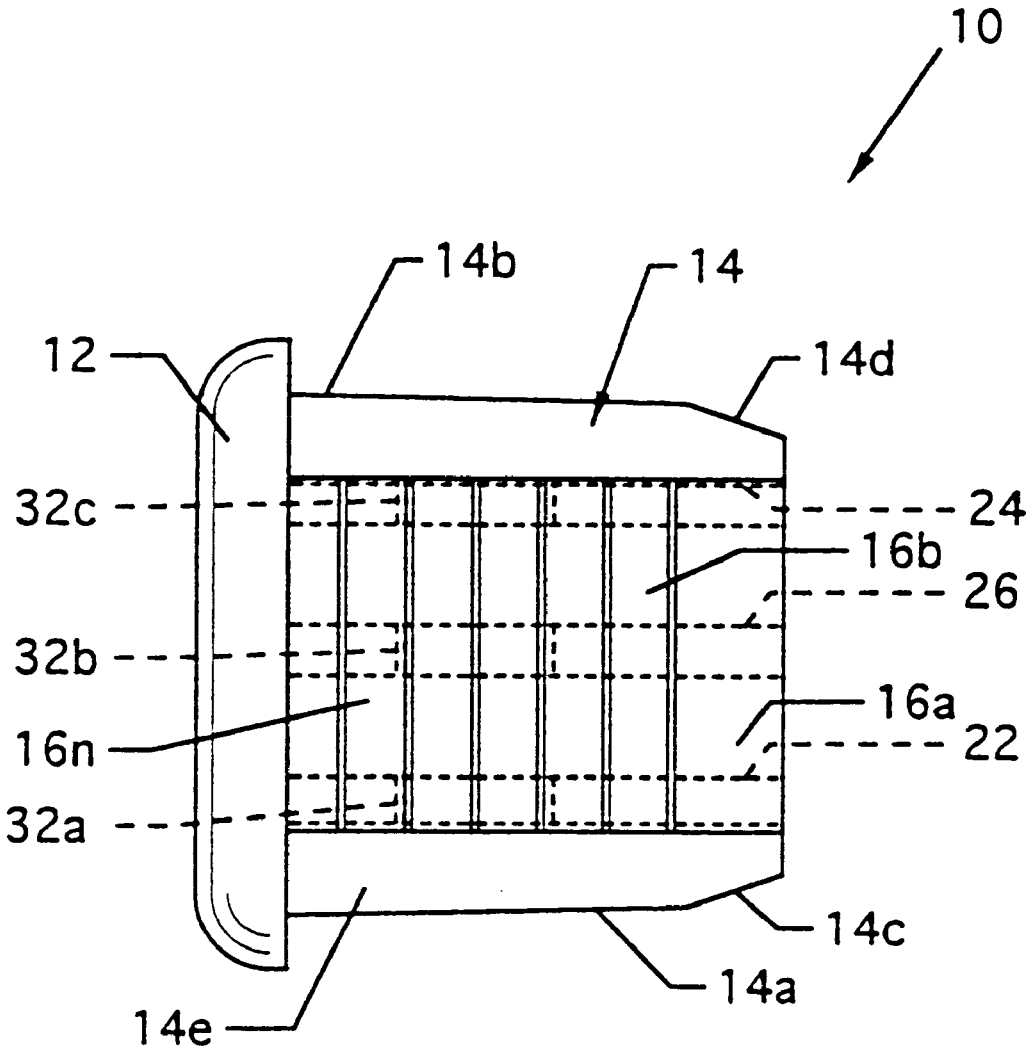
FIG. 3 illustrates a top view of the plug.
Figure 4:
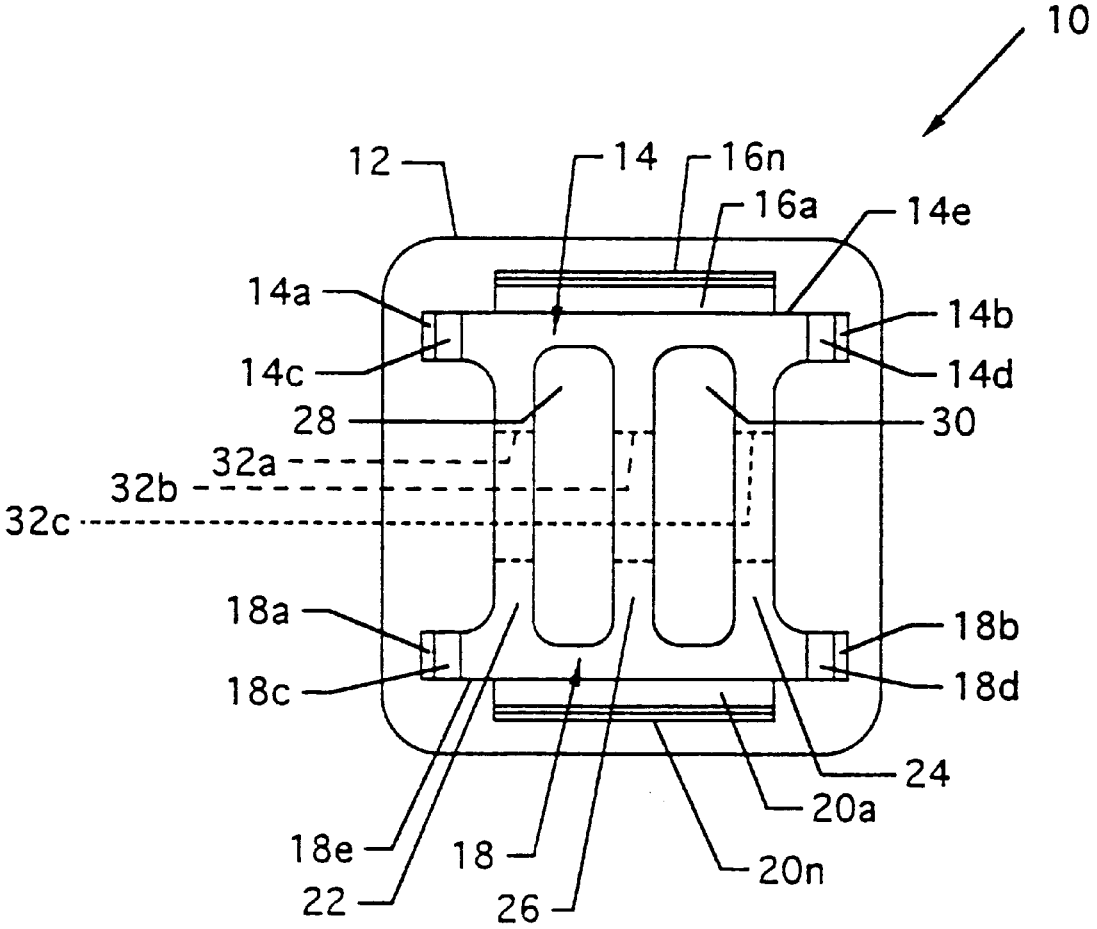
FIG. 4 illustrates an end view of the plug.

FIG. 1 illustrates an isometric view of a one-piece plug 10 such as is used to seal off or close the open ends of tubular support members, such as, but not limited to, square or other rectangular tubular support members on a Bimini boat top or other boat structure having a tubular support member requiring plugging or capping. The one-piece plug 10, fashioned of plastic, rubber or other such suitable material, includes a cap 12 from which a plurality of rearwardly projecting and connected planar support panels extend. An upper tapered planar support panel 14 extends horizontally and rearwardly from the cap 12 and includes opposing tapered edges 14*a* and 14*b*, the tapers of which are widest near the junction of the cap 12 and the tapered edges 14*a* and 14*b* and narrowest near tapered locator or guide edges 14*c* and 14*d*, respectively, which are located at the inboard end of the plug 10. With respect to the centerline of the plug 10, the taper of tapered edges 14*c* and 14*d* exceeds that of the tapered edges 14*a* and 14*b* so that tapered edges 14*c* and 14*d* serve as alignment enhancing surfaces for facilitating insertion of the plug 10 into open tubular support member ends, while the tapered edges 14*a* and 14*b* serve as alignment surfaces for deeper tubular support member penetration. With reference to FIGS. 1 and 2, an outwardly protruding array of ramped teeth 16*a*–16*n* is located on the upper or top surface 14*e* of the upper planar support panel 14. The angle or pitch of tooth 16*a* is shallower than that of teeth 16*b*–16*n* to generally replicate the same angle as presented by the tapered edges 14*c* and 14*d* to aid in initial location and insertion of the plug 10 into an open tubular support member end. The angle or pitch of teeth 16*b*–16*n* with respect to the top surface 14*e* is greater than that angle or pitch between the top surface 14*e* and the angle presented by tooth 16*a*. As illustrated in FIGS. 2, 3 and 4, a similarly fashioned lower tapered planar support panel 18 extends horizontally and rearwardly from the cap 12 and includes opposing tapered edges 18*a* and 18*b*, the tapers of which are widest near the junction of the cap 12 and the tapered edges 18*a* and 18*b* and narrowest near tapered locator or guide edges 18*c* and 18*d*, respectively, which are located at the inboard end of the plug 10. With respect to the centerline of the plug 10, the taper of tapered edges 18*c* and 18*d* exceeds that of the tapered edges 18*a* and 18*b* so that tapered edges 18*c* and 18*d* serve as alignment enhancing surfaces for facilitating insertion of the plug 10 into open tubular support member ends, while the tapered edges 18*a* and 18*b* serve as alignment surfaces for deeper tubular support member penetration. An outwardly protruding array of ramped teeth 20*a*–20*n* is located on the lower or bottom surface 18*e* of the lower planar support panel 18. The angle or pitch of tooth 20*a* is shallower than that of teeth 20*b*–20*n* to generally replicate the same angle as presented by the tapered edges 18*c* and 18*d*, as well as tapered edges 14*c* and 14*d*, to aid in initial location and insertion into an open tubular support member end. The angle or pitch of teeth 20*b*–20*n* with respect to the bottom surface 18*e* is greater than that angle or pitch between the bottom surface 18*e* and the angle presented by tooth 18*a*. Outer vertically oriented support panels 22, 24 and a center vertically oriented support panel 26 align supportively between the upper tapered planar support panel 14 and the lower tapered planar support panel 18, and also intersect the cap 12 to lend rigidity between the upper and lower tapered planar support panels 14 and 18 and to the overall structure of the plug 10. Weight reducing voids 28 and 30 are formed between the outer vertically oriented support panels 22, 24, the center vertically oriented support panel 26, the upper and lower tapered planar support panels 14 and 18, and the cap 12. Horizontally aligned holes 32*a*, 32*b* and 32*c* mutually align in vertical support panels 22, 26 and 24, respectively, as illustrated in FIG. 4, to accommodate a connection pin, shown later in detail.

Figure 5:
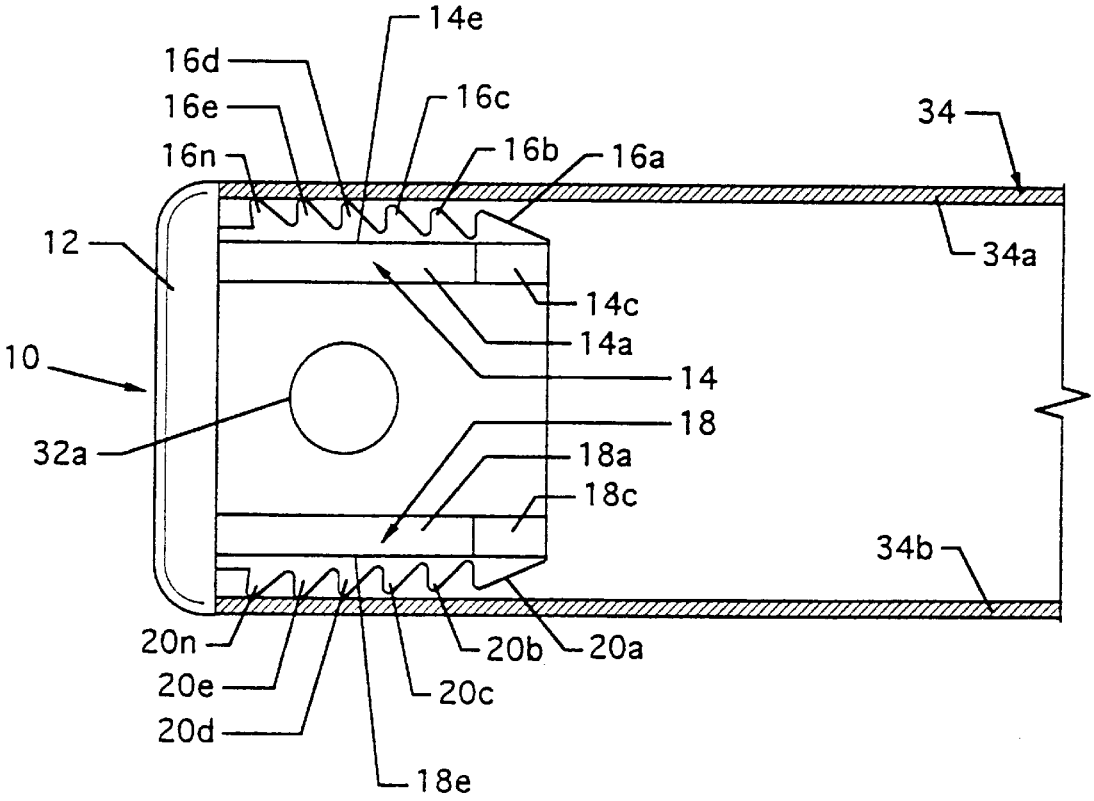
FIG. 5 illustrates a side view of the plug in frictional engagement with a tubular support member which is shown partially and in cross section; and, FIG. 6 illustrates the use of the plug connecting a tubular support member to a rail.

FIG. 2 illustrates a side view of the plug 10, where all numerals correspond to those elements previously described. Illustrated in particular is the arrangement of the ramped teeth 16*a*–16*n* and 20*a*–20*n* which engage the interior of a tubular support member as shown in FIG. 5. With respect to the horizontally aligned upper tapered planar support panel 14 and the centerline of the plug 10, it can be seen that, starting from the right side of the plug 10, the height of the teeth 16*a*–16*n* increases incrementally in a ramped fashion from right to left having a maximum tooth height nearest the cap 12. The ramping of the teeth 16*a*–16*n* allows for accommodational frictional engagement with various inside dimensions of tubular support members. The teeth 16*a*–16*n*, being narrower at the outer teeth tip areas, flex during frictional engagement and flex in increasing degrees along the plurality of teeth 16*a*–16*n*, to firmly engage the interior of a tubular support member. A number of adjacent teeth in the plurality of teeth 16*a*–16*n* progressively and in unison with opposing like teeth 20*a*–20*n*, grip the interior of the tubular support member in wedge-like fashion.

FIG. 3 illustrates a top view of the plug 10, where all numerals correspond to those elements previously described. Illustrated in particular are the tapered edges 14*a*, 14*c*, 14*b* and 14*d* of the upper planar support panel 14 which have corresponding tapered edges 18*a*, 18*c*, 18*b* and 18*d* located on the lower planar support panel 18, as illustrated in FIG. 4. The taper of tapered edges 14*c* and 14*d* exceeds that of the tapered edges 14*a* and 14*b* so that tapered edges 14*c* and 14*d* serve as alignment enhancing surfaces for facilitating location and insertion of the plug 10 into the open tubular support member end, while the tapered edges 14*a* and 14*b* serve as alignment surfaces for deeper tubular support member penetration. Tapered edges 18*a*, 18*c*, 18*b* and 18*d* are incorporated and function in a similar fashion.

FIG. 4 illustrates an end view of the plug 10, where all numerals correspond to those elements previously described. Illustrated in particular is the alignment of the holes 32*a*, 32*b* and 32*c* in the outer support panel 22, the center support panel 26, and the outer support panel 24, respectively.

FIG. 5 illustrates a side view of plug 10 in frictional engagement with a tubular support member 34 which is shown partially and in cross section, where all numerals mentioned before correspond to those elements previously described. The tubular support member 34, being of nominal wall thickness, is shown in frictional engagement with teeth 16*n* and 16*e* on the upper region of the plug 10 and in frictional engagement with teeth 20*n* and 20*e* on the lower region of the plug 10. Teeth 16*n* and 20*n*, having the greatest offset from the centerline of the plug, are in flexed impingement with the interior surfaces of the walls 34*a* and 34*b*, respectively, of the tubular support member 34. Teeth 16*e* and 20*e* tangentially impinge the interior surfaces of the walls 34*a* and 34*b*, respectively, of the tubular support member 34 in concert with teeth 16*n* and 20*n* and in combination to frictionally engage and secure the plug 10 to the interior of the tubular support member 34. It can be seen that a tubular support member having a thicker wall thickness would additionally engage an increased number of teeth, such as teeth 16*d* and 16*c* and teeth 20*d* and 20*c*, for purposes of illustration, whereby engagement and flexing of an increased number of teeth would occur and increase the holding power via increased frictional engagement. The plug 10 is inserted into the end of the tubular support member 34 until the cap 12 comes in contact with the end of the tubular support member 34. Thus, the plug 10 is incorporated into the end of a tubular support member 34 to seal the end to prevent entry of fingers as well as other objects such as dirt, insects, moisture and the like. In addition, a pin is usually inserted through holes 32*a*, 32*b* and 32*c* and corresponding holes in the tubular support member 34 to anchor the tubular support member 34 to a mounting structure such as, but not restricted to, nautical support rails and other supports. The pin 46, illustrated in FIG. 6, also serves as an additional means of securement of the plug 10 in the end of the tubular support member 34.

Figure 6:
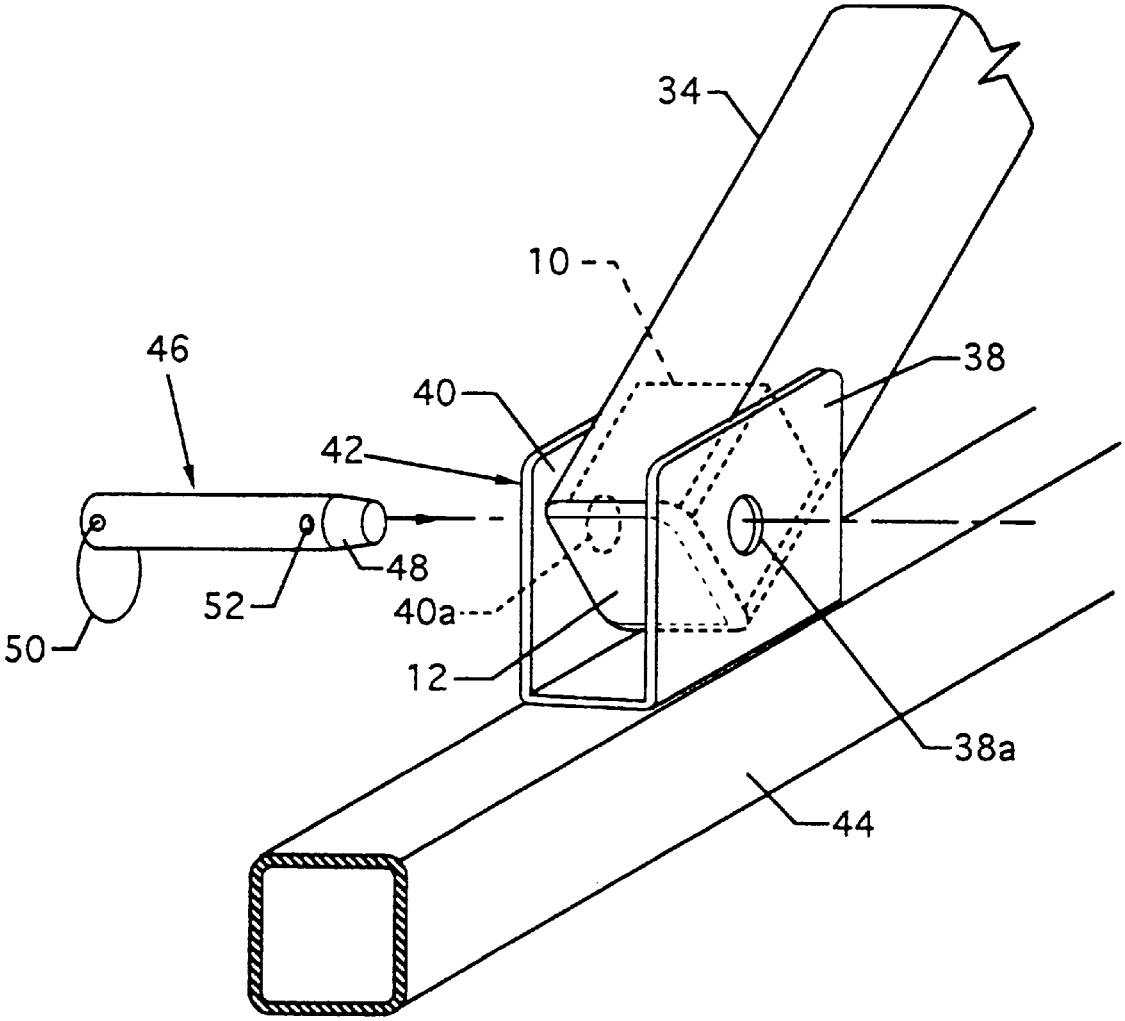

FIG. 6 illustrates the use of the plug 10, the present invention, where all numerals mentioned before correspond to those elements previously described. The plug 10, shown in simplified form, frictionally engages the end of tubular support member 34, and the end of the tubular support member 34 containing the plug 10 is aligned between opposing sides 38 and 40 of a mounting bracket 42 which is mounted on support structure such as a boat rail 44. The sides 38 and 40 of the mounting bracket 42 include opposing holes 38*a* and 40*a*, respectively, which align with plug 10 holes 32*a*, 32*b* and 32*c* previously described. A pin 46, having a tapered end 48, a ring 50, and one or more spring loaded ball latches 52, is inserted through hole 40*a* in the mounting bracket side 40, through the holes 32*a*, 32*b* and 32*c* in the plug 10, and then through hole 38*a* in the mounting bracket side 38 to pivotally secure the end of the tubular support member 34 to the mounting bracket 42 and thus to the boat rail 44. One or more ball latches 52 pass through the hole 38*a* in the mounting bracket 42 to retain the pin 46.

Although the plug 10 is illustrated and described as being generally square in shape, the plug 10 could take on rectangular shapes other than square, could be of other polygonal shapes, or could even have a geometrical shape other than polygonal for use with tubular members having correspondingly shaped interiors. Also, the weight reducing voids 28 and 30 could be eliminated, thus giving the plug 10 a generally solid form. Still further, the end of the cap can be substantially flat, as illustrated, or can have a rounded form. Hence, neither the precise shape nor the exact form of the plug as illustrated in the drawings shall be deemed to be limiting to the scope of the invention.

Various modifications can be made to the present invention without departing from the apparent scope hereof.

It is claimed:

1. A plug for capping or sealing an open end of a tubular member, comprising:

a. a cap having a front side and a rear side;

b. an upper panel having an outer surface, an inner surface, a first end, a second end, and first and second sides, said first end of said upper panel being united to said rear side of said cap and extending substantially perpendicularly from said rear side of said cap, and said first and second sides of said upper panel converging from said first end of said upper panel toward said second end of said upper panel;

c. a lower panel spaced from said upper panel, said lower panel having an outer surface, an inner surface, a first end, a second end, and first and second sides, said first end of said lower panel being united to said rear side of said cap and extending substantially perpendicularly from said rear side of said cap, and said first and second sides of said lower panel converging from said first end of said lower panel toward said second end of said lower panel;

d. a body portion extending between said upper and lower panels and united to said inner surfaces of said upper and lower panels;

e. a first array of ramped teeth protruding outwardly from said outer surface of said upper panel; and, f. a second array of ramped teeth protruding outwardly from said outer surface of said lower panel.

2. A plug as defined in claim 1, wherein said body portion includes first and second support panels united to and extending substantially perpendicularly from said rear side of said cap, said first and second support panels being spaced apart and together with said upper and lower panels defining a hollow area.

3. A plug as defined in claim 2, wherein said first and second support panels are both planar.

4. A plug as defined in claim 2, wherein each of said first and second support panels has a hole extending transversely therethrough, said holes being aligned with each other and capable of receiving a pin therethrough.

5. A plug as defined in claim 2, wherein said first and second support panels are located inwardly of said first and second sides of said upper and lower panels.

6. A plug as defined in claim 1, wherein said body portion includes first and second outer support panels and a center support panel located between and spaced from said first and second outer support panels, said first and second outer support panels and said center support panel all being united to and extending substantially perpendicularly from said rear side of said cap, said first outer support panel and said center support panel together with said upper and lower panels defining a first hollow area, and said second outer support panel and said center support panel together with said upper and lower panels defining a second hollow area.

7. A plug as defined in claim 6, wherein each of said first and second outer support panels and said center support panel is planar.

8. A plug as defined in claim 6, wherein each of said first and second outer support panels and said center support panel has a hole extending transversely therethrough, said holes being aligned with each other and capable of receiving a pin therethrough.

9. A plug as defined in claim 6, wherein said first and second outer support panels are located inwardly of said first and second sides of said upper and lower panels.

10. A plug as defined in claim 1, wherein each ramped tooth of said first and second arrays of ramped teeth has a tip and a portion which slopes from the tip toward the respective outer surface of said upper and lower panels in the direction toward said second ends of said upper and lower panels.

11. A plug as defined in claim 10, wherein each ramped tooth of said first and second arrays of ramped teeth has a height defined by the distance from the respective outer surface of said upper and lower panels to its tip, and wherein said heights progressively increase from said second ends of said upper and lower panels to said first ends of said upper and lower panels.

12. A plug as defined in claim 1, wherein each ramped tooth of said first and second arrays of ramped teeth has a tip, and wherein the dimensions of said cap are such that the periphery of said cap extends outwardly beyond the tips of said ramped teeth of said first and second arrays of ramped teeth and outwardly beyond said first and second sides of said upper and lower panels.

13. A plug as defined in claim 1, wherein said cap is substantially square in shape.

14. A plug as defined in claim 1, wherein said upper and lower panels are both planar.

15. A plug as defined in claim 1, wherein said converging first and second sides of said upper and lower panels each converge at a first taper from said first ends of said upper and lower panels to a point intermediate said first and second ends of said upper and lower panels and at a second taper, steeper than said first taper, from said point to said second ends of said upper and lower panels.

16. A plug as defined in claim 1, wherein said cap, said upper panel, said lower panel, said body portion, said first array of ramped teeth, and said second array of ramped teeth all constitute a one-piece, unitary member.

17. A plug for capping or sealing an open end of a tubular member, comprising:

a. a cap having a front side and a rear side;

b. a plurality of panels connected to and extending rearwardly from said rear side of said cap and including an upper panel having an outer surface and an inner surface, a lower panel having an outer surface and an inner surface, and a plurality of support panels extending between and connected to said inner surfaces of said upper and lower panels; and, c. said outer surfaces of said upper and lower panels each having a separate array of ramped teeth extending outwardly therefrom.

18. A plug as defined in claim 17, wherein the individual ramped teeth of said separate arrays of ramped teeth progressively increase in height from the respective outer surface of said upper and lower panels from a minimum height remote from said cap to a maximum height adjacent to said cap.

19. A plug as defined in claim 17, wherein each said upper panel and said lower panel has two sides which taper toward each other in the direction away from said cap.

20. A plug as defined in claim 19, wherein all of said support panels are located inwardly of said two sides of each of said upper and lower panels.

* * * * *